US006676481B2

(12) United States Patent
Klaus et al.

(10) Patent No.: US 6,676,481 B2
(45) Date of Patent: Jan. 13, 2004

(54) WIRE MAZE TOY

(75) Inventors: Kathy A. Klaus, Alberta (CA); Patrick D. Bidwell, Alberta (CA)

(73) Assignee: Educo International, Inc., Alberta (CA)

( * ) Notice: Subject to any disclaimer, the term of this patent is extended or adjusted under 35 U.S.C. 154(b) by 0 days.

(21) Appl. No.: 10/361,106

(22) Filed: Feb. 7, 2003

(65) Prior Publication Data

US 2003/0162476 A1 Aug. 28, 2003

Related U.S. Application Data

(60) Provisional application No. 60/355,156, filed on Feb. 8, 2002.

(51) Int. Cl.[7] ..... A63H 33/00

(52) U.S. Cl. ..... 446/489; 273/158; 446/97; 446/268; D21/482

(58) Field of Search ..... 446/487, 268, 446/97, 373, 374, 99, 101, 486, 489, 242, 236, 227, 351, 177; D21/482, 104, 105, 106, 107; 273/158; 434/393

(56) References Cited

U.S. PATENT DOCUMENTS

| | | | | | |
|---|---|---|---|---|---|
| 4,603,853 | A | * | 8/1986 | Satterthwaite | 482/35 |
| 4,878,670 | A | * | 11/1989 | Bernauer | 273/158 |
| D309,165 | S | * | 7/1990 | Kaplan et al. | D21/468 |
| 5,112,268 | A | | 5/1992 | Klaus | |
| 5,114,377 | A | * | 5/1992 | Cove Mercuri et al. | 446/487 |
| D333,495 | S | * | 2/1993 | Klaus | D21/468 |
| D334,952 | S | * | 4/1993 | Davis et al. | D21/482 |
| 5,230,631 | A | * | 7/1993 | Halmaghi et al. | 434/284 |
| 5,255,457 | A | * | 10/1993 | Lipson | 40/744 |
| 5,725,214 | A | * | 3/1998 | Adams | 273/158 |
| 6,203,398 | B1 | * | 3/2001 | Lin | 446/489 |
| 6,398,617 | B1 | * | 6/2002 | Nelson | 446/268 |
| 6,524,112 | B1 | * | 2/2003 | Kiel | 434/290 |
| 6,537,130 | B1 | * | 3/2003 | Lee et al. | 446/375 |
| 2002/0182576 | A1 | * | 12/2002 | Kiel | 434/278 |

FOREIGN PATENT DOCUMENTS

| | | | | | |
|---|---|---|---|---|---|
| GB | 2038067 | A | * | 7/1980 | A63B/59/00 |

* cited by examiner

*Primary Examiner*—Derris H. Banks
*Assistant Examiner*—Urszula M Cegielnik
(74) *Attorney, Agent, or Firm*—John Smith-Hill; Smith-Hill and Bedell

(57) ABSTRACT

A wire maze toy includes an endless wire frame that is of substantially uniform cross-sectional configuration over its entire length and is configured to form multiple curves. A carriage including two slider members is fitted on the wire frame and is slidable along the wire frame. A spring structure has two ends connected to the two slider members respectively. The spring structure and the wire frame are dimensionally related such that tension in the spring structure depends on relative positions of the slider members along the wire frame.

11 Claims, 5 Drawing Sheets

WIRE MAZE TOY

CROSS-REFERENCE TO RELATED APPLICATION

This application claims benefit of the date of filing of U.S. Provisional Application No. 60/355,156 filed Feb. 8, 2002.

BACKGROUND OF THE INVENTION

This invention relates to a wire maze toy.

A conventional wire maze toy comprises a wooden base on which are mounted the two ends of an essentially rigid wire bent into an interesting shape, such as loops and spirals. The wire carries free moving, brightly colored beads, which are typically made of wood. A child can move the beads along the wire into different patterns. This activity exercises the child's counting ability, strategic thinking, spatial awareness and physical dexterity. When carried out in conjunction with a teacher or parent, this activity can also assist in development of language skills, educating the child with respect to words of position and orientation such as top, bottom, middle, over, under, left, right, through, up and down. When the wires and beads are of multiple colors and the beads are of different shapes, they can be used to teach color and shape recognition.

Wire maze toys that are currently commercially available employ multiple wires. This mode of construction is relatively complicated and expensive.

U.S. Pat. No. 5,112,268 discloses a wire maze toy in which the opposite ends of a single length of wire are joined to provide an endless frame. The wire is bent to form multiple curves and the curves of the wire at the bottom of the toy lie in a plane to form a flat supporting surface for the frame.

U.S. Pat. No. 5,112,268 suggests that the opposite ends of the wire may be secured together by spot welding or by fitting the ends of the wire in a tube. However, none of the techniques disclosed in U.S. Pat. No. 5,112,268 for joining the ends of the wire has been found to be completely satisfactory. For example, use of a connecting sleeve in which the two opposite ends of the wire are fitted results in the frame being thicker at the location of the sleeve than elsewhere, which can make it difficult for a child to move the beads past the joint.

SUMMARY OF THE INVENTION

In accordance with a first aspect of the invention there is provided a wire maze toy comprising an endless wire frame of substantially uniform cross-sectional configuration over its entire length, the wire frame being configured to form multiple curves, and a carriage including two slider members fitted on the wire frame and slidable along the wire frame, and a spring means having two ends connected to the two slider members respectively, the spring means and the wire frame being dimensionally related such that tension in the spring means depends on relative positions of the slider members along the wire frame.

In accordance with a second aspect of the invention there is provided a wire maze toy comprising a substantially rigid wire having two opposite ends, the wire between its ends being bent to form curves and the two opposite ends of the wire being axially aligned and there being an axial hole in each end of the wire, a dowel pin having two opposite ends received respectively in the axial holes in the two opposite ends of the wire, material bonding the two opposite ends of the dowel pin to the two opposite ends respectively of the wire, and a slider member fitted on the wire and slidable along the wire.

In accordance with a third aspect of the invention there is provided a wire maze toy comprising a substantially rigid wire having two opposite ends, the wire between its ends being bent to form multiple curves, and a carriage including two slider members fitted on the wire and slidable along the wire, and a spring means having two ends connected to the two slider members respectively, the spring means and the wire being dimensionally related such that tension in the spring means depends on relative positions of the slider members along the wire.

Broadly stated, in one aspect the invention is concerned with a wire maze toy in which the wire is endless. This type of toy is well suited for a child engaged in manipulative play, and because the toy is light and sturdy, it can be carried from location to location. Because it is not necessary to place the toy on a table or other flat surface, the toy is particularly convenient for engaging the attention of a child when traveling. In another broad aspect, the present invention is concerned with a wire maze toy in which two or more beads, and preferably at least three beads, are threaded on the wire and are interconnected by tension springs so that a child playing with the toy can observe that movement of one bead along the wire may influence another bead otherwise than by direct contact.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
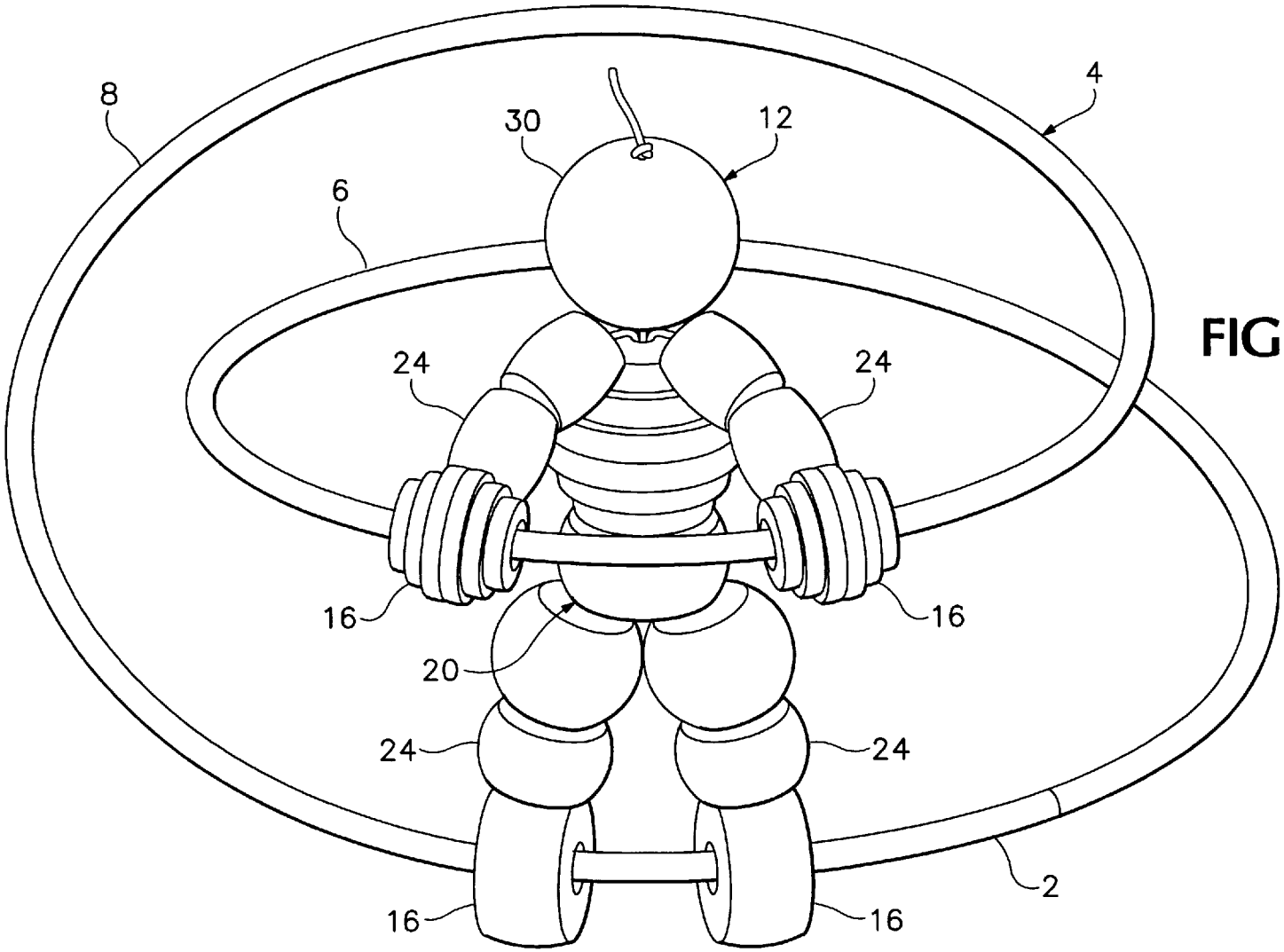
FIG. 1 is a perspective view of a first wire maze toy embodying the present invention.
Figure 2:
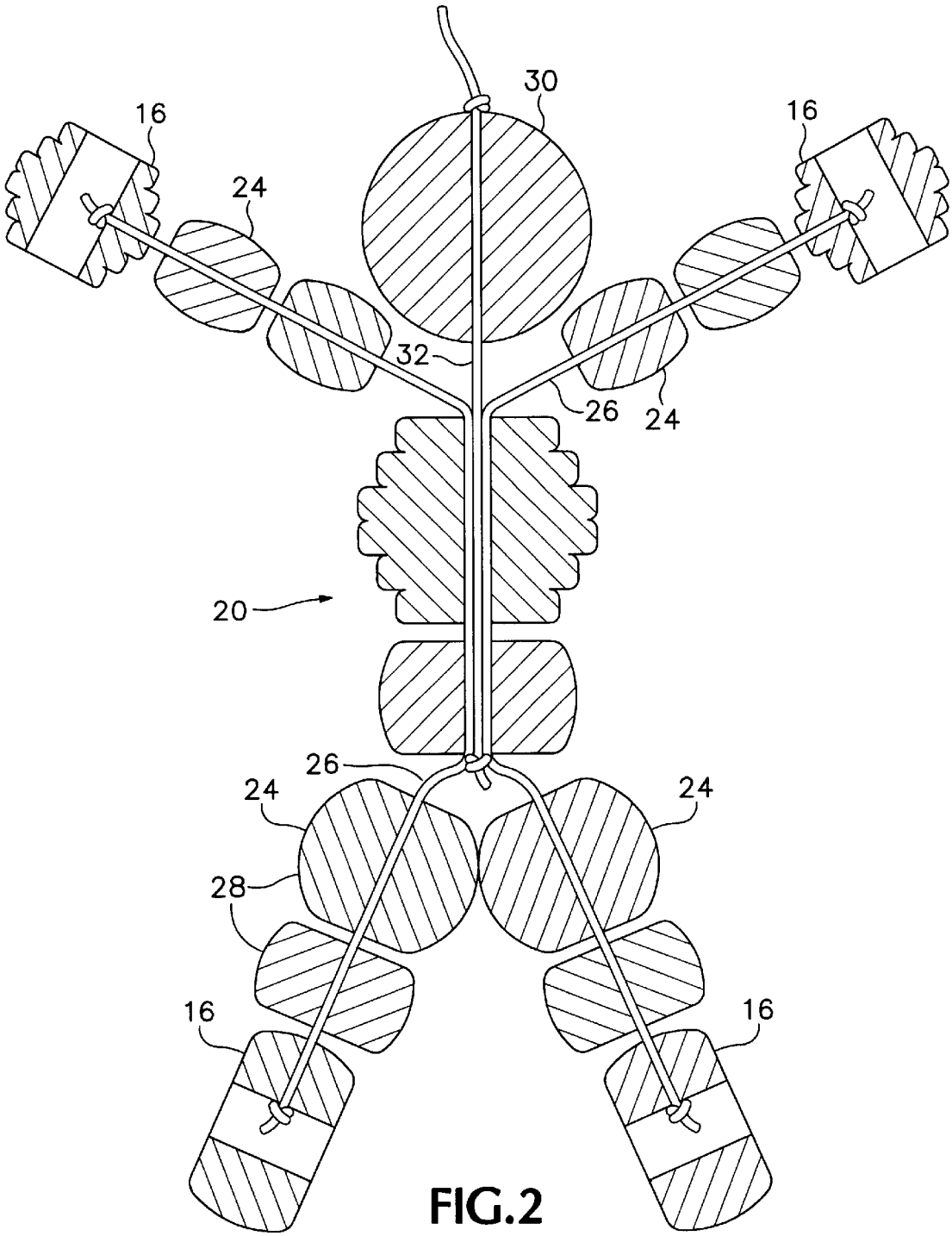
FIG. 2 is a sectional view of a component of the toy shown in FIG. 1.

The wire maze toy illustrated in FIGS. 1 and 2 comprises a wire 2 bent to form an endless frame 4 composed of two loops 6, 8 of smaller and larger diameter respectively. Each loop has substantially the form of one turn of a helix and each loop is joined at its two opposite ends to the two ends of the other loop. In the case of the embodiment shown in FIGS. 1 and 2, the wire is made of steel and is very stiff and is resilient. Although an adult may be able to deform the frame by manual pressure, a large force is required to deform the frame beyond its elastic limit. A small child cannot deform the frame significantly by manual pressure, so that the frame appears rigid to the child.

A carriage 12 is captive on the wire frame and is movable along the wire frame. As shown in FIGS. 1 and 2, the carriage comprises four slider members or beads 16 that are threaded by the wire and are connected to an inner core 20 by respective radial limbs 24. Each radial limb includes a tension spring 26 connecting the outer bead 16 to the inner core 20 and spacers 28 threaded by the tension spring.

Each bead 16 is slidable along the wire frame 4. Sliding movement of a bead 16 along the wire frame 4 is influenced by friction between the bead and the frame and by tension in the spring that is connected to the bead. Because the two loops 6, 8 of the wire frame are of different curvature, and there are two regions of the frame where the curvature changes substantially, tension in the springs biases the carriage towards a configuration in which all four beads 16 are on the smaller loop 6. A child playing with the toy can move one or more beads along the wire frame and observe the way in which this movement affects, or is affected by, other components of the carriage.

The carriage may include an auxiliary spacer 30 that is attached to the core 20 by a tension spring 32 at a location close to the shorter radial limbs of the carriage. The auxiliary spacer 30 is sized so that when it is pushed between the shorter radial limbs, the shorter limbs are forced apart, increasing the tension in the springs of those limbs, and tension in the spring 32 is increased. Accordingly, the auxiliary spacer 30 has two positions of stable equilibrium relative to the two shorter limbs and can be readily moved from one position to the other.

In a preferred embodiment, as shown in FIGS. 1 and 2, the carriage is proportioned to represent a human figure. Thus, the two shorter radial limbs represent the arms of the human figure and the two longer radial limbs represent the legs of the human figure, and each of the springs 26 is threaded through two spacers that are connected in series and form, respectively, the upper and lower portions of the respective limb. In this case also, the auxiliary spacer 30 represents the head of the human figure and the inner core 20 is composed of two beads corresponding respectively to the thoracic and pelvic regions of the human figure. The springs are provided by elastic threads which are secured at their opposite ends by knotting.

It will be appreciated from FIG. 2 that interference between the thigh spacers and between each thigh spacer and the pelvis bead affects the relative positions of the foot beads 16.

Figure 3:
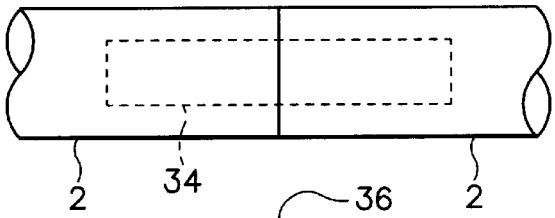
FIG. 3 is an enlarged view illustrating a feature of construction of the toy shown in FIG. 1.

Referring to FIG. 3, the frame 4 is made by drilling a hole into each end of the wire 2 before bending the wire to shape. After drilling the holes, the wire is bent to shape, the carriage is threaded onto the wire and the two ends of the wire are aligned. A drop of adhesive is placed in each hole, the opposite ends of a steel dowel 34 are inserted in the two holes respectively, and the ends of the wire are forced into end-to-end abutting relationship. The adhesive is allowed to cure and a seamless joint is thereby created. Beads can easily be moved over the joint.

Figure 4:
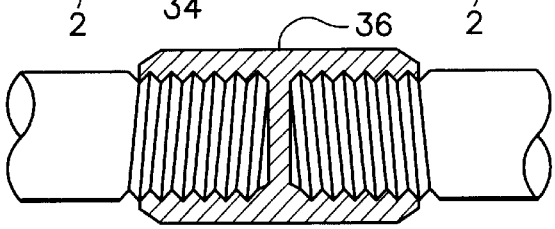
FIG. 4 illustrates a first alternative to the feature of construction shown in FIG. 3.

FIG. 4 illustrates a first alternative mechanism for securing the two ends of the wire. One end of the wire is provided with an external right hand screw thread and the other end is provided with an external left hand screw thread and a sleeve 36 is provided with corresponding internal screw threads. The carriage is placed on the wire, the wire is bent to the appropriate configuration, and the two opposite ends are brought into axial alignment with the threaded sleeve therebetween. By turning the sleeve, the internal screw threads of the sleeve engage the external screw threads of the two opposite ends of the wire and pull the ends of the wire together into end-to-end relationship.

Figure 5:
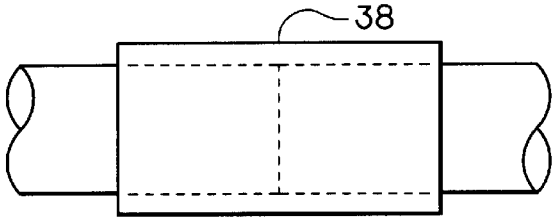
FIG. 5 illustrates a second alternative to the feature of construction shown in FIG. 3.

FIG. 5 illustrates a second alternative mechanism for securing the two ends of the wire. A vinyl protective sleeve 38 is placed on one end of the wire and the two end faces of the wire are prepared for welding, e.g. by sanding. The wire is bent to the appropriate configuration and the carriage is placed on the wire and the two ends of the wire are brought into axial alignment. The two ends are welded together and after welding any rough edges are smoothed by sanding. The vinyl sleeve is then moved over the weld and is held in position by gluing.

Figure 6:
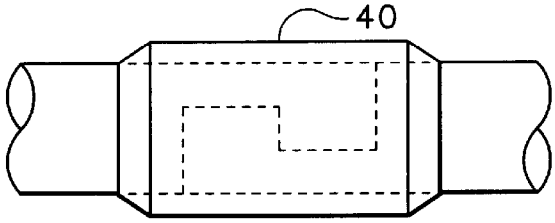
FIG. 6 illustrates a third alternative to the feature of construction shown in FIG. 3.

FIG. 6 illustrates a third alternative mechanism for securing the two ends of the wire. A metal sleeve 40 is placed over one end of the wire and the two ends are prepared by cutting complementary notch formations. The notch formations have faces that are parallel to the longitudinal axis of the wire and faces that are perpendicular to the longitudinal axis of the wire. The wire is then bent to the appropriate configuration and the carriage is placed on the wire and the two complementary formations are brought into engagement. The metal sleeve is then moved along the wire so that it extends over the joint, and is glued in position.

Figure 7:
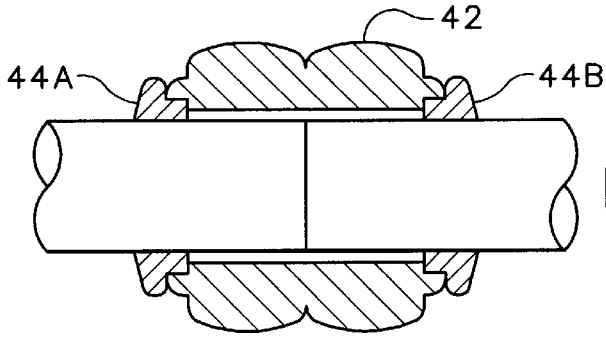
FIG. 7 illustrates a fourth alternative to the feature of construction shown in FIG. 3.

FIG. 7 illustrates a fourth alternative mechanism for securing the two ends of the wire. A bead 42 and a first alignment spacer 44A are placed on the wire at one end thereof and a second alignment spacer 44B is placed on the wire at the opposite end. The bore of the bead 42 is substantially greater in diameter than the wire and each alignment spacer 44, which is a relatively snug fit on the wire, includes a hub that fits closely in the bore of the bead. The two ends of the wire are prepared for welding, e.g. by sanding, and the wire is bent to the appropriate configuration, described with reference to FIG. 1. The carriage is placed on the wire and the two ends of the wire are brought into axial alignment. The two ends of the wire are welded together and after welding any rough edges are removed, for example by sanding. The bead 42 is then positioned over the welded joint, the hubs of the two alignment spacers 44 are fitted in the opposite ends of the bore of the bead and the alignment spacers are glued to the bead and to the wire. It will be appreciated that in the case of the structure shown in FIG. 7, the movement of the carriage on the frame is constrained by the mechanism used to connect the two ends of the wire.

Figure 8:
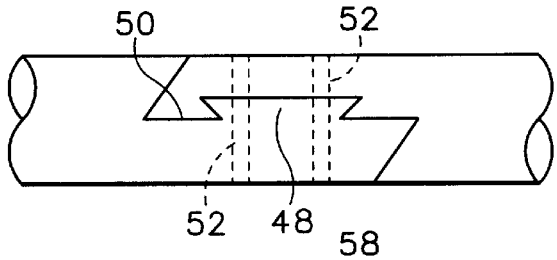
FIG. 8 illustrates a fifth alternative to the feature of construction shown in FIG. 3.

FIG. 8 illustrates a fifth alternative mechanism for securing the two ends of the wire. One end of the wire is provided with a dovetail tenon 48 and a dovetail groove 50 and the other end is provided with complementary formations. Each end of the wire is formed with holes to receive rivets 52. The two ends are brought into engagement and rivets are installed in the holes to secure the ends together.

Figure 9:
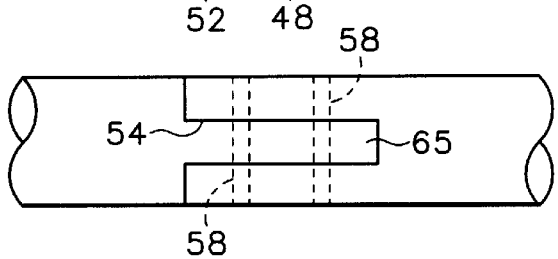
FIG. 9 illustrates a sixth alternative to the feature of construction shown in FIG. 3.

FIG. 9 illustrates a sixth alternative mechanism for securing the two ends of the wire. One end of the wire is formed with a longitudinal slot 54 and the opposite end is formed with a longitudinal tenon 65 dimensioned to fit in the slot. Each end of the wire is formed with holes to receive rivets. The two ends are brought into engagement and rivets are installed in the holes to secure the ends together.

Figure 10:
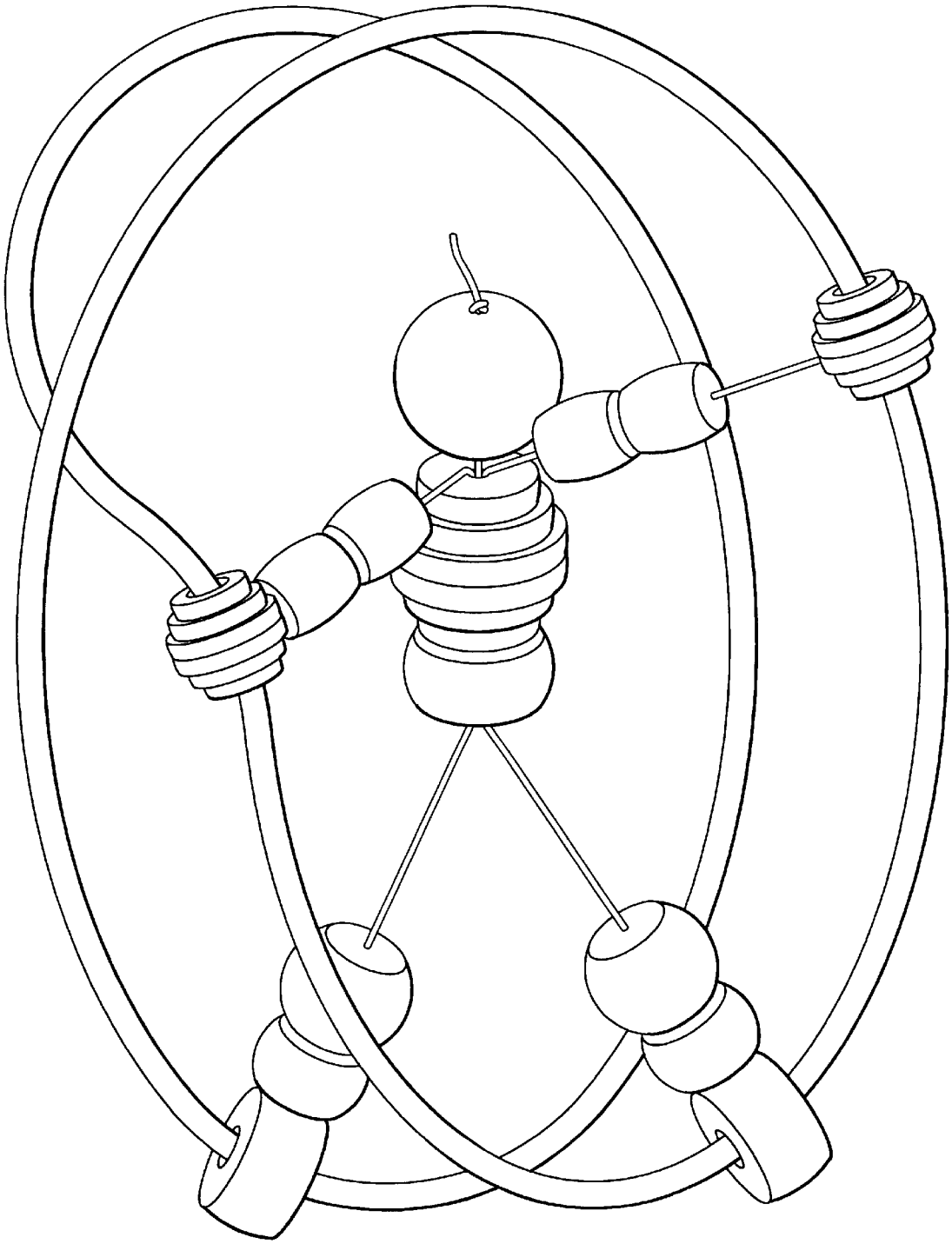
FIG. 10 illustrates a second wire maze toy embodying the present invention.

In the toy shown in FIG. 10, the two loops of the wire frame are of equal diameter. Each loop is part circular, rather than helical, and the two loops are essentially parallel to each other. The two loops are connected together by two length segments that are inclined relative to the planes of the loops. The wire maze toy shown in FIG. 10 is rollable.

The wire 2 of the toy shown in FIGS. 1 and 2 is a steel wire, and may be a powder-coated steel wire. Although the frame that is used in the toy shown in FIGS. 1 and 2 is made from steel wire, and the alternative constructions described with reference to FIGS. 3–9 also employ frames made of steel wire, the term "frame" as generally used in this specification is not restricted to an article made of a wire of steel or other metal but covers articles made of other materials that are able to perform the functions required of the frame. Similarly, the term "wire" as generally used in this specification is not restricted to an article made of steel or other metal but covers articles made of other materials that are able to perform the functions required of the wire. For example, the frame may be made of an injection-molded synthetic polymer material that is semi-rigid in nature. Preferred polymer materials are POM and nylon. In the case of the frame being made by injection molding, the frame can be made as one or more loops without its being necessary to join two ends of a wire together. Alternatively, the frame may be made by injection molding PP plastic over a metal wire armature. In this case, the ends of the wire are brought into close end-to-end relationship prior to molding the plastic over the wire, but it is not necessary that the ends of the wire be joined together prior to molding.

Figure 11:
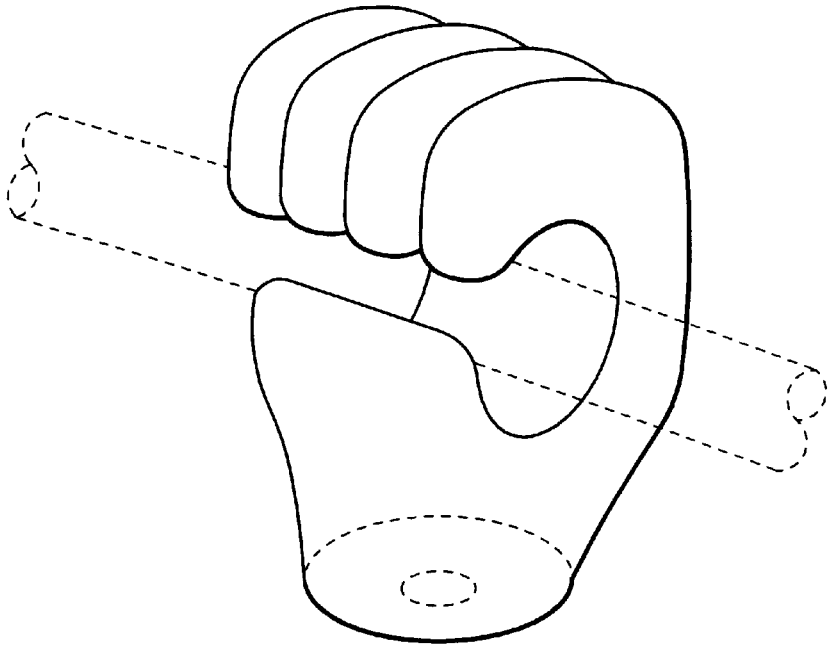
FIGS. 11 and 12 illustrate details of a third wire maze toy embodying the present invention.
Figure 12:
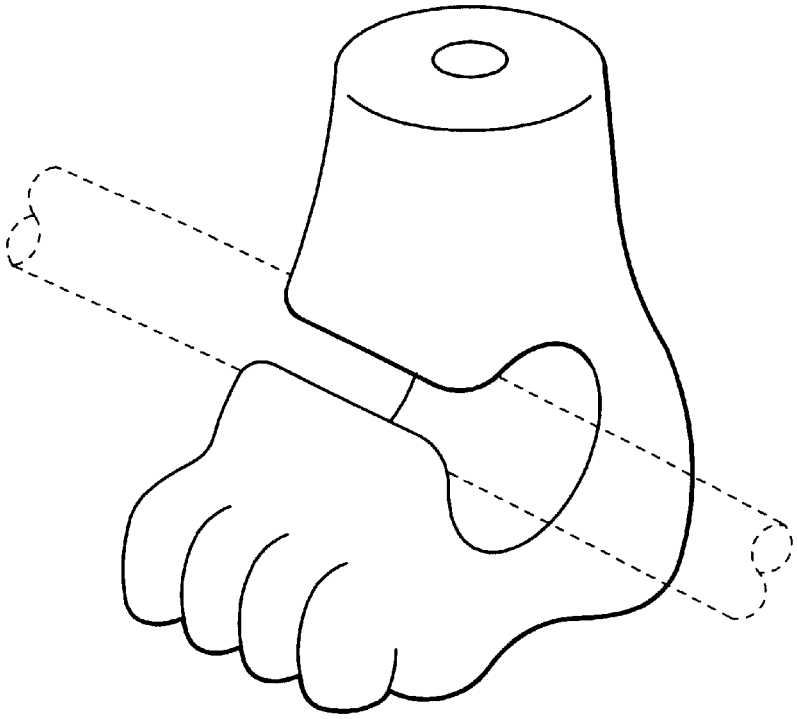

It will be appreciated from the foregoing description of FIGS. 1–10 that in the event that the slider members are beads, it is necessary to form a join in the wire and complete fabrication of the frame after the beads have been threaded onto the wire. FIGS. 11 and 12 show slider members that can be attached to the frame after fabrication of the frame is complete. The slider members shown in FIGS. 11 and 12 are configured as a hand and a foot respectively, and each defines a passage and a restricted throat that leads to the passage. The slider member is snapped onto the wire by forcing the wire through the throat, and the wire then extends with clearance through the passage.

It will be appreciated that many modifications may be made to the toy that has been described above by reference to the various embodiments illustrated in FIGS. 1–12. For example, although in each of the embodiments the carriage represents a human figure, the carriage may alternatively represent another animate object or character that might be recognizable to a child playing with the toy or might represent a fanciful animal or an inanimate object. In keeping with the carriage representing a human figure, in each embodiment, the carriage has four limbs extending from the core, but the carriage may have fewer than four limbs or more than four limbs, particularly in the case in which the carriage does not represent an animal. Further, in each of the illustrated embodiments of the invention, all four limbs are provided with beads that run on the wire frame, but in a modification one or more limbs, preferably two limbs, may be free of the frame while the remaining limbs are provided with beads that run on the frame.

Although in the case of the illustrated embodiments of the invention, the endless frame has two loops, the invention is not restricted to the frame having this configuration.

It will be appreciated that the invention is not restricted to the particular embodiment that has been described, and that variations may be made therein without departing from the scope of the invention as defined in the appended claims and equivalents thereof. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated.

What is claimed is:

1. A wire maze toy comprising:

an endless wire frame of substantially uniform cross-sectional configuration over its entire length, the wire frame being configured to form multiple curves, and a carriage including two slider members fitted on the wire frame and slidable along the wire frame, and a spring means having two ends connected to the two slider members respectively, the spring means and the wire frame being dimensionally related such that tension in the spring means depends on relative positions of the slider members along the wire frame.

2. A wire maze toy according to claim 1, wherein the carriage includes four slider members fitted on the wire frame and slidable along the wire, and wherein the spring means includes four elastic strands connected to the four slider members respectively.

3. A wire maze toy according to claim 1, wherein the spring means comprises two elastic strands attached to the two slider members respectively, and the carriage further includes a core to which opposite ends of the two elastic strands are secured.

4. A wire maze toy according to claim 1, wherein the slider members each define a passage through which the wire extends and a restricted throat for snapfitting the slider member onto the wire.

5. A wire maze toy according to claim 1, wherein the endless wire frame is made of injection molded synthetic polymer material.

6. A wire maze toy comprising:

a substantially rigid wire having two opposite ends, the wire between its ends being bent to form curves and the two opposite ends of the wire being axially aligned and there being an axial hole in each end of the wire, a dowel pin having two opposite ends received respectively in the axial holes in the two opposite ends of the wire, material bonding the two opposite ends of the dowel pin to the two opposite ends respectively of the wire, and a slider member fitted on the wire and slidable along the wire.

7. A wire maze toy comprising:

a substantially rigid wire having two opposite ends, the wire between its ends being bent to form multiple curves, and a carriage including two slider members fitted on the wire and slidable along the wire, and a spring means having two ends connected to the two slider members respectively, the spring means and the wire being dimensionally related such that tension in the spring means depends on relative positions of the slider members along the wire.

8. A slider device for use with a wire frame to provide a wire maze toy, the slider device comprising:

at least two slider members each defining a passage and a restricted throat, whereby the wire frame may be forced through the throat so that the wire frame extends through the passage, and a spring means having two ends connected to the two slider members respectively.

9. A slider device according to claim 8, wherein the spring means comprises two elastic strands attached to the two slider members respectively, and the slider device further comprises a core to which opposite ends of the two elastic strands are secured.

10. A wire maze toy comprising:

a wire frame, and a slider member mounted on the wire frame and slidable along the wire frame, the slider member defining a passage through which the wire frame extends and a restricted throat through which the wire frame may be forced for removing the slider member from the wire frame.

11. A wire maze toy according to claim 10, further comprising at least one additional slider member mounted on the wire frame and slidable along the wire frame and a spring means having two ends connected to the slider members respectively.

* * * * *